United States Patent [19]

Fritchman

[11] 4,401,418

[45] Aug. 30, 1983

[54] MUFFLER SYSTEM FOR REFRIGERATION COMPRESSOR

[75] Inventor: Jack F. Fritchman, Cullman, Ala.

[73] Assignee: White Consolidated Industries, Inc., Cleveland, Ohio

[21] Appl. No.: 258,667

[22] Filed: Apr. 29, 1981

[51] Int. Cl.[3] ..... F04B 11/00; F04B 21/00

[52] U.S. Cl. ..... 417/312; 417/540; 417/902; 62/296; 181/403

[58] Field of Search ..... 62/296; 417/902, 312, 417/313, 363, 415, 540; 137/573, 590; 181/246, 272, 233, 239, 403

[56] References Cited

U.S. PATENT DOCUMENTS

| | | | |
|---|---|---|---|
| 1,402,896 | 1/1922 | Schneebeli | 181/272 |
| 3,044,688 | 7/1962 | Frank et al. | 417/902 X |
| 3,075,686 | 1/1963 | Steinhagen | 417/363 |
| 3,876,339 | 4/1975 | Gannaway | 417/312 |
| 4,313,715 | 2/1982 | Richardson, Jr. | 417/312 |

*Primary Examiner*—Carlton R. Croyle
*Assistant Examiner*—Donald E. Stout
*Attorney, Agent, or Firm*—Pearne, Gordon, Sessions, McCoy, Granger & Tilberry

[57] ABSTRACT

A hermetic reciprocating piston refrigeration compressor has a high efficiency muffler system. The suction muffler has an inlet adjacent the refrigerant return line and is made of an insulating material. It is mounted on a pair of suction tubes secured to the cylinder head and extending into the interior of the muffler. A discharge muffler system includes a pair of large muffler chambers formed partially in a cylinder block and connected by an external transfer tube. A large straight passage connects the discharge plenum in the cylinder head with one muffler chamber, while a discharge line extends from the other muffler chamber to the exterior of the compressor casing.

17 Claims, 4 Drawing Figures

MUFFLER SYSTEM FOR REFRIGERATION COMPRESSOR

BACKGROUND OF THE INVENTION

This invention relates generally to hermetic refrigeration compressors of the type used in household appliances, and more particularly to suction and discharge muffler systems for single reciprocating piston compressors.

Household refrigerators and freezers generally use relatively low horsepower compressors in the range of 1/6 to ⅓ horsepower, and tend to run the compressor on a relatively long-duty cycle to obtain the necessary cooling, so that under very high ambient temperature conditions, the duty cycle may approach 100 percent. One of the reasons for this approach is not only the low original cost of a relatively small compressor, but also because smaller compressors tend to produce less noise, which is a very important factor with household appliances of this type. Generally, the compressors are of the hermetically sealed type containing a motor compressor unit resiliently mounted on springs within the hermetic case, and employ a single cylinder with a reciprocating piston therein, usually driven by a two-pole motor, so that the operating speeds tend to approach, under relatively low-load running conditions, the maximum speed of 3600 rpm with a 60 Hz power supply. Likewise, for reasons of simplicity of construction and long life, these compressors use reed-type suction and discharge valves to control the flow of gases into and out of the cylinder, and such valves are operated, of course, by the flow of the gas itself, and therefore open and close quite abruptly. Because of the high speed and the action of the valves, as well as the normal pumping action, such compressors tend to make a considerable amount of noise as a result of the gas flow through them, apart from other mechanical noises. Thus, to achieve the desired quietness of operation, it has been necessary to supply suction and exhaust mufflers to silence both the intake of air from inside the casing into the cylinder and the flow of compressed gas out of the discharge valve to the discharge line from the compressor casing. Because the intake pressure is relatively low, the suction valves do not require as much dampening action on the pulses and must allow higher rates of flow, while the discharge valves operate under high pressure but lower volume of compressed gas, so that the construction of the suction and discharge mufflers tends to be quite different.

While normally such mufflers are designed primarily with respect to their effect in quieting the compressor while retaining low cost of manufacture, it has become increasingly important in recent years to increase the overall efficiency of the compressor to thereby increase the overall efficiency of the appliance to obtain at least equal amounts of cooling using less power to drive the compressor. However, it is recognized that with relatively small compressors of the type used in refrigerators and freezers, the design parameters can become quite different from those employed to increase efficiency in much larger compressors such as multiple piston compressors used in large air conditioning installations. Increasing the overall efficiency of a refrigeration compressor must take place generally in one of three areas: first, by increasing the efficiency of the electric motor driving the compressor; second, by decreasing mechanical friction losses in the moving parts; and third, by increasing the volumetric efficiency of the compressor. While volumetric efficiency is affected by a large number of factors, such as the efficiency of the suction and discharge valves, the clearance volume in the cylinder when the piston is at top dead center, and the temperature of the low pressure return refrigerant gas entering the compressor suction, another area where substantial increases in efficiency can be obtained is in the efficiency of the suction and discharge mufflers themselves, i.e., by making such mufflers so that they provide minimum throttling or restriction of gas flow both to and from the cylinder while still providing sufficient silencing of the gas flow, and with a minimum of increase in cost of manufacture of the entire compressor. Likewise, the fact that such compressors must have a generally small outer casing to take up a minimum amount of space within the refrigerator or freezer provides definite limitations in the size and construction of the mufflers, as well as the other parts of the compressor.

SUMMARY OF THE INVENTION

The present invention provides a novel construction for both the suction and discharge mufflers to increase the volumetric efficiency of the compressor without any corresponding increase in noise. The preferred embodiment of this invention is applied to a hermetic refrigeration compressor utilizing a cylinder block resiliently mounted within a sheet metal case. An electric motor is mounted on top of the cylinder block to drive a crankshaft rotating about a vertical axis and a single cylinder extends radially to the crankshaft, which utilizes a conventional connecting rod to reciprocate a piston within the cylinder on the lower side of the cylinder block. A cylinder head is mounted on the cylinder block at one side and contains suction and discharge plenum chambers which are connected to the cylinder through appropriate reed valves formed in sheets of springlike material clamped between the cylinder head and the cylinder block.

The suction muffler is mounted on a pair of tubes that extend upwardly from the suction plenum chamber in the cylinder head, and consists of a hollow body of a non-metallic, plastic material which extends vertically upward alongside the motor to fit within the space between the motor and the compressor case. The suction muffler includes a central partition dividing the interior into two compartments each of which connects to the plenum through a separate suction tube. The inlet to these chambers is through a generally horizontal suction passage which opens to the exterior on the sidewall of the muffler shell, which has a deflector lying in substantially a vertical plane and extending outwardly adjacent the motor. The return line to the compressor casing opens into the interior in substantial alignment with the deflector, so that the incoming suction gas strikes the deflector and any oil in the return gas can separate out on the deflector plate and drip off its lower edge into the interior. After the gas strikes the deflector, it passes through the suction passage, into the interior of the muffler, and from there through the suction tubes into the suction plenum chamber in the cylinder head.

The discharge muffler consists of a pair of chambers formed on the lower side of the cylinder block on opposite sides of a line passing through the cylinder and the crankshaft. The discharge gases pass from the discharge plenum chamber in the cylinder head through a relatively large diameter passage to the first muffler chamber in the cylinder block. Each of the muffler chambers is substantially the same in volume, and consists partially of a portion formed as a recess within a cylinder block, together with a hemispherical cap bolted in place. A transfer tube extends between the two hemispherical caps to conduct the discharge gas from the first chamber into the second chamber, and this tube is relatively restricted in size as compared to the passage from the cylinder head plenum chamber into the first muffler. A second tube then extends from the cap on the second muffler chamber through the necessary convolutions to allow flexing, and to the exterior of the casing. Because of the relatively large diameter passage between the cylinder head plenum and the first muffler chamber, the gases pass easily and with minimum restriction into the first muffler chamber, while the restricted transfer tube slows down the passage as a choke as the gases pass over into the second muffler chamber. The second chamber allows additional expansion, and each of the muffler chambers is sized to have a volume between three and six times the swept displacement of the cylinder. Thus, the muffler system does provide two large expansion volumes interconnected by a relatively long transfer tube that tends to act as an inductive choke to the chamber's capacitance to form an effective low bandpass filter, while the overall resistance of the system is kept relatively low by the large volume of the muffler chambers and the unrestricted passage from the cylinder head plenum to the first muffler chamber.

The combination of these two mufflers with the suction muffler adapted to receive gas directly from the return line with a minimum of heating within the compressor case provides a high degree of volumetric efficiency for the compressor, while retaining multiple chamber filters which allow a satisfactorily high degree of sound reduction so that the compressor can operate as quietly as possible.

DESCRIPTION OF THE PREFERRED EMBODIMENT

Figure 1:
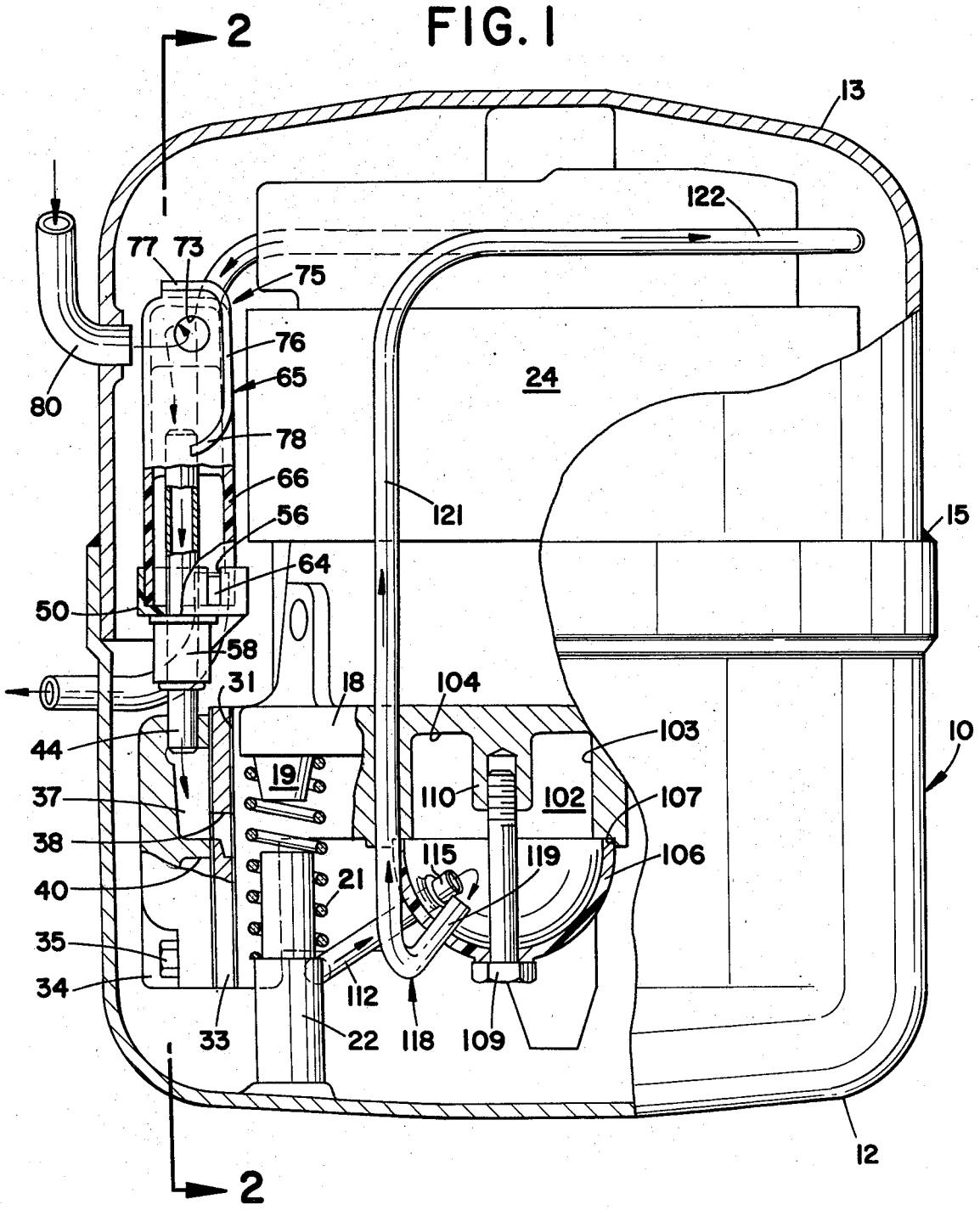
FIG. 1 is a side elevational view, partially in section, of a hermetic refrigeration compressor incorporating the present invention, showing details of the suction muffler and second discharge muffler chamber.

The drawings show a hermetic sealed refrigeration compressor of the type commonly used in household refrigerators and other refrigerating units, in which a sealed casing contains a compressor having a single piston reciprocated by a crankshaft and connecting rod arrangement within a cylinder block and the crankshaft in turn is driven by a suitable electric motor. The electric motor and cylinder block form a unitary subassembly which is resiliently mounted on springs within the casing, and the return line from the refrigeration system opens into the interior of the casing which is therefore filled with refrigerant and a suitable lubricating oil in a reservoir in the bottom. The outlet from the compressor then passes through an elongated passage arranged to permit resilient movement of the motor cylinder block assembly outwardly through the casing to the inlet side of the refrigeration system. It will be understood that since the present invention relates to the suction and discharge mufflers of the compressor many details of the compressor are not shown except as a background for the present invention since they form no part of the present invention itself.

The compressor therefore has a casing or shell 10 preferably formed from a relatively heavy steel sheet and includes a cuplike lower section 10 and similar inverted cup-like upper section 13 which fit together telescopically and are secured and sealed by a welded seam 15. The compressor subassembly includes a cylinder block or housing 18 which is spaced away from the sidewalls of the case 10 and is resiliently mounted by a plurality of projections 19 on the lower side of the cylinder block which are received in support springs 21 engaged at their other end in support legs 22 secured to the bottom wall of the lower section 12. Although the support springs 21 are shown as being four in number, this is by way of illustration only and other resilient mounting arrangements may be used as is well known in the art.

Figure 4:
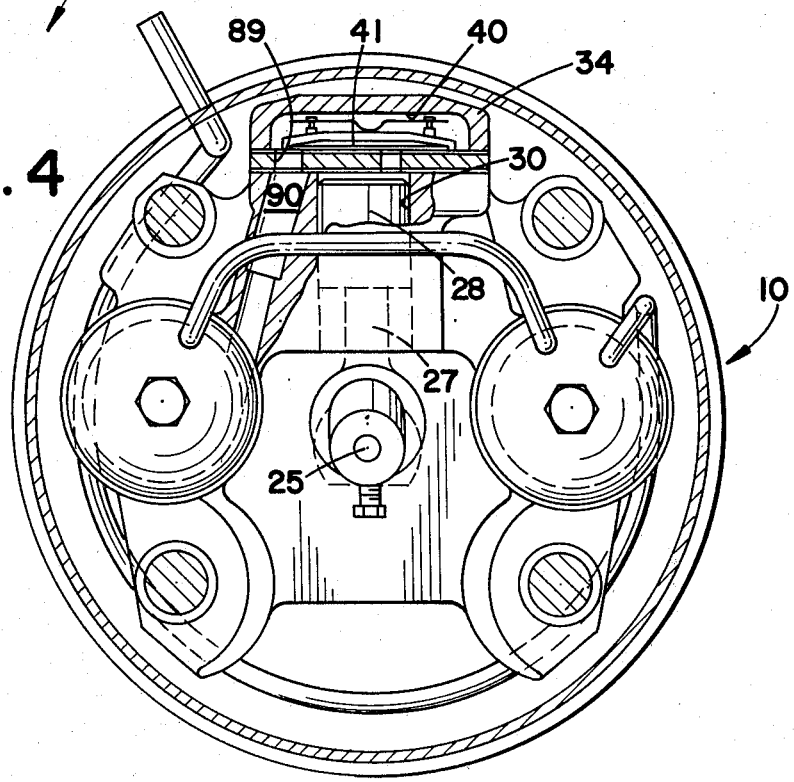
FIG. 4 is a cross-sectional view, taken on line 4—4 of FIG. 2, showing the general arrangement of the two discharge muffler chambers.

On the upper side of the cylinder block 18 is located an electric motor indicated generally by numeral 24 which is adapted to rotate a crankshaft 25 extending along a generally vertical axis within the case 10. At its lower end, the crankshaft 25 has a suitable eccentric (not shown) arranged to drive a connecting rod 27 (see FIG. 4) and thereby reciprocate a piston 28 within a horizontally extending bore 30 in the cylinder block 18.

At the radially outer end of bore 30, the cylinder block 18 is formed with a flat end face 31 to which are secured a valve plate 33 and cylinder head 34 by suitable means such as bolts 35. It will be understood that the valve plate 33 mounts the suction and discharge valves in the usual manner and suitable gaskets are provided between the valve plate 33 and end face 31 as well as between the cylinder head 34 and the valve plate 33. As shown in greater detail in FIG. 2, the cylinder head 34 defines an inlet or suction plenum 37 which is connected by an inlet port 38 through the suction valve to the interior of cylinder bore 30. The cylinder head 34 also includes a discharge plenum chamber 40 within which is mounted the discharge valve 41.

Figure 2:
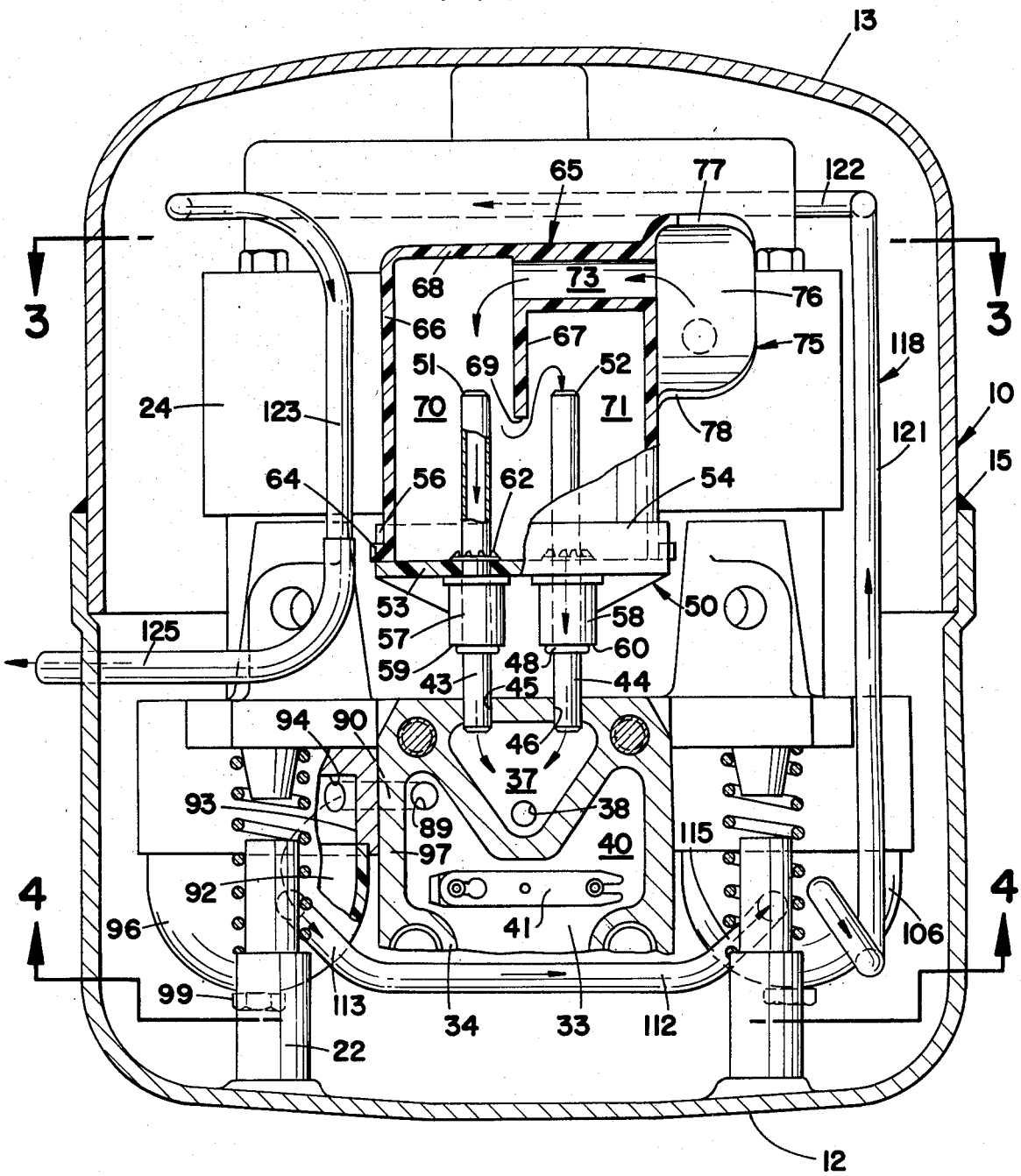
FIG. 2 is a cross-sectional, elevational view, taken on line 2—2 of FIG. 1, showing addititonal details of the suction muffler.

On its upper side, the cylinder head 34 carries a pair of left and right suction tubes 43 and 44 which are secured within bores 45 and 46 in the cylinder head 34 to communicate at their lower or inner ends with the inlet plenum 37. The suction tubes 43 and 44 extend vertically upward substantially parallel with each other and serve not only as a passageway to admit the refrigerant gas into the inlet plenum 34, but also the positioning and support means for the suction muffler itself. Accordingly, the suction tubes 43 and 44 have annular beads 48 formed on their outer peripheries a spaced distance above the cylinder head 34 and the suction tubes 43 and 44 extend upwardly through the bottom wall 53 of a suction muffler bottom member 50. As seen in FIG. 2, the bottom member 50 includes a pair of hollow bosses 57 and 58 extending around the suction tubes 43 and 44 and having bottom end faces 59 and 60 bearing against the beads 48 on the tubes. One or more suitable retaining rings 62 are fitted on the suction tubes above the bottom wall 53 and serve to hold the bottom member 50 in place on the suction tube by a resilient clamping ring between the retainer ring 62 and the beads 48. Thus, for ease of assembly, the hollow bosses 57 and 58 need make only a loose sliding fit with the suction tubes 43 and 44, since minor gas leaks at these points do not adversely affect the performance of the muffler.

The bottom member 50 includes an upwardly extending flange or vertical wall 54 extending upwardly from the bottom wall 53 and each side outwardly of the suction tubes 43 and 44 the flange or wall 54 is provided with vertical slots 56. The suction muffler also includes a top member indicated at 65 having a peripheral wall 66 adapted to telescopically to fit within the bottom member flange 54 and this peripheral wall 66 includes an outwardly projecting lugs 64 adapted to fit within the slots 56. The two suction muffler members 50 and 65 are preferably formed from a thermoplastic material which not only has the advantages of being relatively light in weight but also has thermal and acoustical insulating properties as will be described in greater detail hereinafter. However, the use of this material also lends itself to easy assembly of the unit. After the cylinder head 34 is fully machined, the suction tubes 43 and 44 are pressed in place in the bores 45 and 56 and may, if desired, be further held in place by brazing or the use of an adhesive. After this is done, the suction muffler bottom member 50 is placed over the suction tubes 43 and 44 until the boss end faces 59 and 60 abut against the beads 48. Thereafter, one or more retainer rings 62 are placed over the suction tubes 43 and 44 and pressed downward while gripping the outer surface of the suction tube until the bottom member is firmly held in place on the two suction tubes. After this is done, the top member 65 is placed so that the peripheral wall 66 fits within the flange 54 on the bottom member with the lugs 64 in engagement with the slots 56. After this has been done, it is merely necessary to apply heat and pressure such as can be provided by a soldering iron or the like to fuse the lugs 64 and press them into the slots 56 so that they fuse together and provide a permanent attachment between the two suction muffler members as the plastic material under heat flows and welds itself together.

The suction muffler top member 65 includes a peripheral wall 66 of generally oval configuration, but in any case, arranged to give the desired enclosed volume for silencing purposes while maintaining adequate clearance from the electric motor 24 and the case 10. The peripheral wall 66 has a substantially constant cross-sectional shape upward from the lower end and terminates in a top wall 68. The upper portion of the interior of the top member 65 is divided by a transverse partition 67 extending downward from the top wall 68 to terminate at a lower edge 69 below the upper ends 51 and 52 of the suction tubes 43 and 44 and therefore, in effect, the partition 67 divides the interior of the top member 65 into left and right chambers 70 and 71 as shown in greater detail in FIG. 2. The portion of the top member 65 above the right chamber 71 is substantially solid except for a transverse passage 73 extending from the exterior of the muffler to admit the returning refrigerant gases from the space within the case 10 into the left chamber 70. The gases that then flow into the left chamber 70 may either pass directly into the left suction tube 43 or can move around the partition 67 into the right chamber 71 and hence pass through the right suction tube 44, but in each case the gases in the two suction tubes are comingled in the inlet plenum 37.

Figure 3:
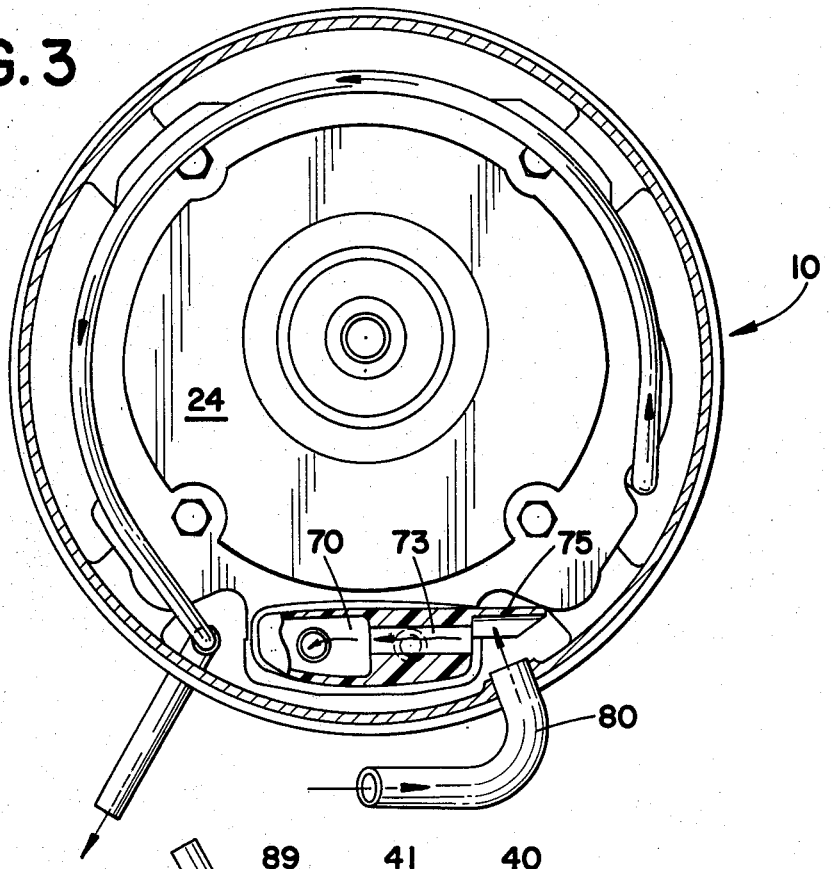
FIG. 3 is a cross-sectional view, taken on line 3—3 of FIG. 2.

In order to direct the returning refrigerant gases directly into the passage 73, the top member 65 is provided with an integral projecting deflector portion 75 extending horizontally outward from the peripheral wall 66 adjacent the passage 73. The deflector 75 includes a central portion 76 extending substantially vertically within the compressor and has a curved top and bottom portion 77 and 78, respectively. As best shown in FIG. 3, the refrigerant return line 80 is directed so that the incoming gas impinges directly on the central portion 76 and can then flow laterally into the passage 73. The top portion 77 tends to prevent the gases from deflecting upwardly while the bottom portion 78 not only serves to deflect gases against flowing downwardly, but also serves to collect and condense the lubricating oil in the return line and since this bottom portion 78 is below the passage 73, any of the oil condensing on the deflector will drip off the bottom portion 78 and flow downwardly into the reservoir at the bottom of the compressor.

Since the incoming return refrigerant gas from the return line 80 impinges immediately on the deflector 75 and enters the muffler through passage 73, it undergoes a minimum of heating either by mixing with the other gases within the casing 10 or exposure to other components of the compressor. Because of the change of direction through approximately a right angle between the return line 80 and the passage 73, any droplets of lubricating oil are effectively removed and do not enter the passage 73 but, rather, collect on the deflector 75 to flow off the bottom portion 78 into the reservoir at the bottom of the compressor casing. Since the entire muffler shell is made of a relatively insulating material, the refrigerant gases can continue through the muffler and into the plenum 37 at the lowest possible temperature, and hence highest density, to ensure maximum volumetric efficiency. By providing the dual suction tubes 43 and 44, not only is the muffler securely mounted in place, but also the muffler provides a minimum of flow restriction while maximizing the reduction of sound from the suction impulses to ensure quiet operation of the compressor.

The discharge muffler system is located beneath the cylinder block 18, and includes a pair of discharge muffler chambers connected by a transfer tube. On the pumping stroke of the piston, the refrigerant gas flows outwardly past the discharge valve 41 into the discharge plenum 40, which is made fairly large in volume so as to cause a minimum pressure build-up from the discharging gas that would reduce the efficiency of the compressor operation. The refrigerant gases in the discharge plenum 40 pass through a discharge opening 89 formed in the valve plate 33, and into a discharge passage 90 formed in the cylinder block 18. This discharge passage 90 has a relatively large diameter to provide a minimum of restriction to the gases, and passes diagonally away from the cylinder bore 30 to open into a first discharge muffler chamber 92. This chamber 92 is formed partially in the cylinder block 18 by a cylindrical wall 93 and upper wall 94, and is enclosed on the lower side by a generally hemispherical, hollow, sheet metal cover 96 which fits within a counterbore 97 in the cylindrical wall 93, and is held in place by a suitable bolt 99 passing axially through the cover 96 and making threaded engagement with the cylinder block.

On the other side of the cylinder block, generally symmetrically positioned with respect to the axis of the cylinder bore 30, is a second muffler chamber 102. This chamber is also formed partially in the cylinder block 18 by a cylindrical wall 103 and upper wall 104. The lower side of the chamber is closed by a generally hollow, hemispherical, sheet metal cover 106 substantially similar in shape to cover 96, and this cover 106 in turn fits within a counterbore 107 formed in the cylindrical wall 103. An axial bolt 109 extends through the cover and engages a projecting boss 110 formed on the cylinder block within the muffler chamber 102. It should be noted that both of the muffler chambers 92 and 102 have substantially similar volumes and shapes, and are generally sized to each have a volume approximately three to six times the swept volume of the cylinder.

The two muffler chambers 92 and 102 are connected by a transfer tube 112 having one end 113 passing through an opening formed in the cover 96, with the other end 115 extending in like manner through a suitable opening formed in the cover 106. To provide positive sealing, both of the ends 113 and 115 are brazed in place in their respective covers, and the transfer tube 112 is of relatively small diameter as compared to the other discharge passages to provide a certain amount of flow impedance to the refrigerant gases, as will be described in greater detail hereinafter.

The refrigerant gases in the second muffler chamber 102 are discharged through a discharge tube 118 having one end secured in the cover 106 and brazed in place in the same manner as the transfer tube. The discharge tube 118 has a vertically extending leg 121 extending upward along the side of the compressor to the upper end where it joins a loop portion 122 extending around the periphery of the compressor and terminating in a downwardly extending leg 123. The downward leg 123 is connected then to an outlet tube 125 extending outwardly through the casing 10 for connection to the rest of the refrigeration system in the manner well known in the art.

This discharge muffler arrangement provides not only a high degree of silencing action, but also a very low effective impedance to the flow of the discharge gases from the pumping cylinder to the outlet tube 125. The two discharge chambers 92 and 102 serve as capacitances, and the relatively small diameter transfer tube 112 effectively serves as an inductance to provide a highly effective low bandpass filter with low overall impedance. The present arrangement allows relatively large volume muffler chambers and, as a result of providing a relatively large volume discharge plenum 40 and large diameter discharge passage 90 with its relatively short length, during the discharge stroke of the piston the gases are able to flow freely through the plenum chamber and discharge passage 90 into the first muffler chamber 92. Because of the large volume of these spaces, the pressure build-up toward the end of the piston stroke is relatively low, resulting in a minimum terminal pressure in the clearance volume at the end of the piston stroke. As the piston then moves on the suction stroke and the discharge valve 41 closes, the gases in the muffler chamber 92 can then pass through the inductive transfer tube 112 into the second large volume or capacitance of the second discharge chamber 102 at a relatively lesser rate of flow until the next discharge stroke of the piston takes place. The gases can then leave the second muffler chamber 102 through the discharge tube 118 and outlet tube 125 with a minimum of noise-producing pulsations.

Although the preferred embodiment of this invention has been shown and described, it should be understood that various modifications and rearrangements of parts may be resorted to without departing from the scope of the invention as defined in the claims.

What is claimed is:

1. A hermetic refrigeration compressor comprising a case having discharge and return lines secured thereto, a motor compressor unit mounted inside said case and including a cylinder housing having a single cylinder and a piston therein, an electric motor secured to the upper side of said cylinder housing to drivingly reciprocate said piston in said cylinder, a cylinder head secured to said cylinder housing, said cylinder head including an inlet chamber and a discharge chamber, discharge muffler means connecting said discharge chamber to said discharge line, a suction muffler connected to said inlet chamber, said suction muffler being supported on at least one suction tube secured to said cylinder head and comprising an elongated closed hollow shell having sidewalls extending longitudinally adjacent said electric motor, said sidewalls defining an inlet opening at the end away from said cylinder head and laterally adjacent said return line on said case, said shell having a deflector extending laterally from the sidewall thereof adjacent said inlet opening and across the return line opening to deflect and guide refrigerant gas from said return line angularly through said inlet opening into the interior of said suction muffler.

2. A hermetic refrigeration compressor as set forth in claim 1, wherein there are two suction tubes secured to said cylinder head and extending through the bottom wall and into the interior of the muffler, and said muffler is rigidly secured to at least one suction tube.

3. A hermetic refrigeration compressor as set forth in claim 2, wherein said suction muffler includes a top wall and an internal partition extending downwardly from said top wall to a point below the upper end of at least one of said suction tubes and being located between said suction tubes.

4. A hermetic refrigeration compressor as set forth in claim 3, wherein said inlet opening is a passage in said top wall opening into the interior of the muffler on the side of said partition away from said deflector.

5. A hermetic refrigeration compressor as set forth in claim 2, wherein the means for securing said muffler to said suction tube includes an annular bead on said suction tube below said muffler bottom wall and a retainer ring secured to said tube above said bottom wall.

6. A hermetic refrigeration compressor comprising a case having a return lined secured thereto, a motor compressor unit mounted inside said case and including a cylinder housing having a single cylinder and piston therein, an electric motor secured to said cylinder housing to drivingly reciprocate said piston in said cylinder, a cylinder head secured to said cylinder housing, said cylinder head including an inlet chamber, a pair of vertically extending suction tubes secured to said cylinder head and opening at their bottom ends into said inlet chamber, a suction muffler secured to the other end of said pair of suction tubes with said other ends extending through the bottom wall a spaced distance into the interior of said suction muffler, said suction muffler comprising a vertically elongated, closed, hollow shell having sidewalls extending longitudinally adjacent said electric motor, said sidewalls defining an inlet opening at the end away from said cylinder head and adjacent said return line on said case.

7. A hermetic refrigeration compressor as set forth in claim 6, wherein said shell is formed of a plastic insulating material and said suction tubes make a sliding fit with said shell, at least one of said suction tubes having an annular bead outside said shell and a retainer ring inside said shell to secure said shell to said one suction tube.

8. A hermetic refrigeration compressor as set forth in claim 7, wherein said shell has an integral deflector extending laterally from the sidewall thereof adjacent said inlet opening and across the return line opening to deflect and guide refrigerant gas from said return line through said inlet opening into the interior of said shell.

9. A hermetic refrigeration compressor comprising a case having discharge and return lines secured thereto, a motor compressor unit mounted inside said case and including a cylinder housing having a single cylinder and a piston therein, an electric motor secured to said cylinder housing to drivingly reciprocate said piston in said cylinder, a cylinder head secured to said cylinder housing, said cylinder head including an inlet chamber and a discharge chamber, suction muffler means connecting said inlet chamber to said return line, discharge muffler means connecting said discharge chamber to said discharge line, said discharge muffler means including first and second muffler chambers connected in series, said chambers being substantially equal in volume and each chamber having a volume of at least three times the swept volume of said piston in said cylinder, an unrestricted large diameter first fluid passage connecting said discharge chamber with said first muffler chamber, a restricted second fluid passage connecting said first muffler chamber to said second muffler chamber, said second passage being longer and of smaller cross-sectional area than said first passage to provide an impedance to flow from said first muffler chamber to said second muffler chamber, and a third fluid passage from said second muffler chamber to said discharge line on said shell.

10. A hermetic refrigeration compressor as set forth in claim 9, wherein said muffler chambers are formed at least partially in said cylinder housing and partially in cover members secured to said cylinder housing.

11. A hermetic refrigeration compressor as set forth in claim 10, wherein said muffler chambers are positioned on said cylinder housing, one on each side of the axis of said cylinder.

12. A hermetic refrigeration compressor as set forth in claim 11, wherein said first fluid passage is a straight passage in said cylinder housing.

13. A hermetic refrigeration compressor as set forth in claim 11, wherein said second fluid passage is an external tube extending between said cover members.

14. A hermetic refrigeration compressor as set forth in claim 13, wherein said third fluid passage is a tube connected to the cover member of said second muffler chamber.

15. A hermetic refrigeration compressor comprising a case, a motor compressor unit mounted inside said case and including a cylinder housing having a single cylinder and a piston therein, an electric motor secured to the upper side of said cylinder housing to drivingly reciprocate said piston in said cylinder, a cylinder head secured to said cylinder housing, said cylinder head including a discharge chamber, discharge muffler means connecting said discharge chamber to said discharge line, said discharge muffler means including first and second muffler chambers connected in series, said chambers being substantially equal in volume and formed at least partially by the lower side of said cylinder housing, said muffler chambers being positioned one on each side of the axis defined by said cylinder, each of said muffler chambers having a volume of at least three times the swept volume of said piston in said cylinder, an unrestricted large diameter first fluid passage connecting said discharge chamber with said first muffler chamber, and a restricted second fluid passage connecting said first muffler chamber to said second muffler chamber, said second passage being longer and of smaller cross-sectional area than said first passage to provide an impedance to flow from said first muffler chamber to said second muffler chamber.

16. A hermetic refrigeration compressor as set forth in claim 15, wherein said first fluid passage is a straight cylindrical bore in said cylinder housing.

17. A hermetic refrigeration compressor as set forth in claim 15, wherein said muffler chambers are partially formed by sheet metal covers secured to said cylinder housing and said second fluid passage is a tube connected to both of said covers.

* * * * *